US007223030B2

(12) United States Patent
Fessler et al.

(10) Patent No.: US 7,223,030 B2
(45) Date of Patent: May 29, 2007

(54) SYSTEMS AND METHODS FOR DETERMINING PHYSICAL LOCATION OF RFID TAGS ON EMBEDDED PRINT MEDIA

(75) Inventors: John Thomas Fessler, Lexington, KY (US); Keith Bryan Hardin, Lexington, KY (US); Mark Stephen Underwood, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/048,328

(22) Filed: Feb. 1, 2005

(65) Prior Publication Data

US 2006/0171753 A1 Aug. 3, 2006

(51) Int. Cl.
*B41J 11/44* (2006.01)

(52) U.S. Cl. ..... 400/76; 400/70; 400/61

(58) Field of Classification Search ..... 400/76, 400/61, 88, 62, 70, 615.2; 235/380, 492; 340/825.72, 572.1
See application file for complete search history.

(56) References Cited

U.S. PATENT DOCUMENTS 6,104,291 A * 8/2000 Beauvillier et al. ..... 340/572.1
6,246,326 B1 6/2001 Wiklof et al. ..... 340/572.1
6,409,401 B1 6/2002 Petteruti et al. ..... 400/88
6,481,907 B2 11/2002 Banach et al. ..... 400/615.2
6,557,758 B1 5/2003 Monico ..... 235/380
6,593,853 B1 7/2003 Barrett et al. ..... 340/572.1
6,747,560 B2 * 6/2004 Stevens, III ..... 340/572.4
6,750,769 B1 6/2004 Smith ..... 340/572.1
6,802,659 B2 * 10/2004 Cremon et al. ..... 400/76
6,827,279 B2 12/2004 Teraura ..... 235/492
6,899,476 B1 * 5/2005 Barrus et al. ..... 400/76
7,037,009 B2 * 5/2006 Barrus et al. ..... 400/76
2005/0280537 A1 * 12/2005 Feltz et al. ..... 340/572.1
2006/0055721 A1 * 3/2006 Burdette et al. ..... 347/19

* cited by examiner

*Primary Examiner*—Andrew H. Hirshfeld
*Assistant Examiner*—Wasseem H. Hamdan
(74) *Attorney, Agent, or Firm*—Lexmark International Inc.

(57) ABSTRACT

A printing system (250) includes a printing subsystem (255) in the form of a printer assembly (14). The printing subsystem (255) includes a printer housing (257) in which a print engine (259) resides and a memory (261) for storing data indicating the position of labels on media. The contents of memory (261) can be obtained from an end user application (270) which may supply the position data to the printing subsystem (255) in a print data stream. Pre-programmed position data is read from a tag (88) on print media (28) having multiple tags embedded thereon. The pre-programmed position data is compared to position data received in a print request data stream to determine the position of at least one tag on the print media.

14 Claims, 5 Drawing Sheets

SYSTEMS AND METHODS FOR DETERMINING PHYSICAL LOCATION OF RFID TAGS ON EMBEDDED PRINT MEDIA

TECHNICAL FIELD

Specific embodiments relate to systems for determining the position of tags on media having one or more embedded pre-programmed radio frequency tags. More particularly, the invention relates to a system using a radio frequency reader for reading pre-programmed data from one or more radio frequency identification tags to determine the position of at least one tag on the print media.

BACKGROUND OF THE INVENTION

Inkjet and laser printers have become commonplace equipment in most workplace and home computing environments. Today, many printers are multi-functional assemblies capable of printing on a large array of print media including letterhead, paper envelopes and labels. A recent innovation in the printing industry involves the manufacturing of print media with embedded radio frequency signatures in the form of Radio Frequency Identification (RFID) transponders or tags. These tags, sometimes called "Smart Labels", may be used with a variety of existing printing methods.

Embedded print media generally comprises a backing material (sometimes referred to as the "web") upon which a label is applied, with a RFID tag sandwiched in between the label and the backing material. There may be one or more labels on the web and the sheet, as presented, may be part label and part plain paper. In some cases, there may be more than one tag arrayed across the width and down the length of the media such that multiple columns and/or rows of tags are contained on the print media.

Another similar type of embedded print media is known as "Smart Paper" in which RFID tags are embedded into the media without labels. One application for Smart Paper is in the area of secure document storage where access to information printed on a document is controlled by use of data control mechanisms such as Access Control List ("ACL") embedded in a tag on the media. To control access, a radio frequency reader/programmer situated near a control point, such as an access control cabinet, can check the ID of a user wanting to access the cabinet against the ACL on the tag on the media. If the ID of the user and the ACL do not match, an alarm can be invoked to notify of an attempted breach in security. In addition, the information on the ACL can be spread among a plurality of tags on a single sheet of print media to accommodate multiple accesses by multiple users while saving media costs.

One of the benefits of printing labels on a cut-sheet printer such as a laser or inkjet printer is that the relatively wide format allows for multiple columns of labels to be used. The use of multiple columns improves the overall rate at which the labels can be printed. At the same time, because the customer can print more than one label for each sheet printed, the relative cost of each label is greatly reduced.

Accordingly, printing of on media with embedded RFID tags is rapidly becoming a growing area of label printing. Each tag on a sheet can be printed with certain data, and the RFID tag embedded within that media can be used to allow individualized processing of user associated data. For example, a shipping label might have the delivery address and a package tracking ID printed on it, while the corresponding tag would be programmed with the same information. The delivery information can then be read from the tag, whether or not the package is positioned so that the tag is visible.

It is desirable that the same efficiencies found in multi-label sheets of traditional label media be realized in RFID embedded media. The problem this presents is the need to correlate the printed data on the sheet with the data programmed into each tag. As such, a means of locating each tag's physical position on the sheet during the printing and programming process in order to ensure that the correct data is programmed into each tag would provide numerous advantages.

BRIEF DESCRIPTIONS OF THE DRAWINGS

The present invention is illustrated by way of example and not limitation in the figures of the accompanying drawings in which like references indicate similar elements, and in which.

Figure 3A:
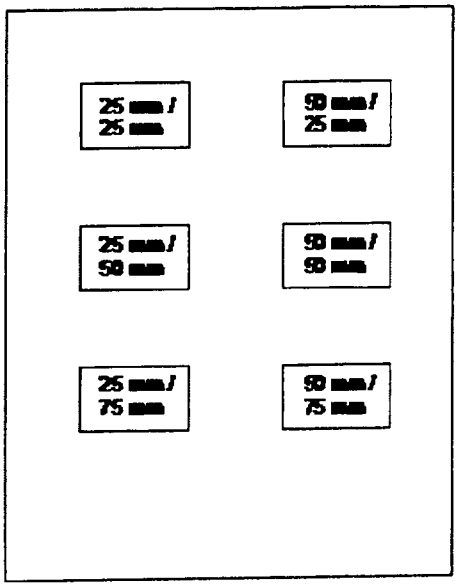
Figure 3B:
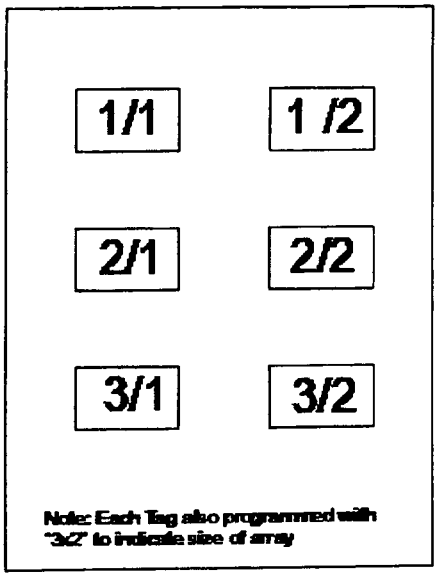
Figure 3C:
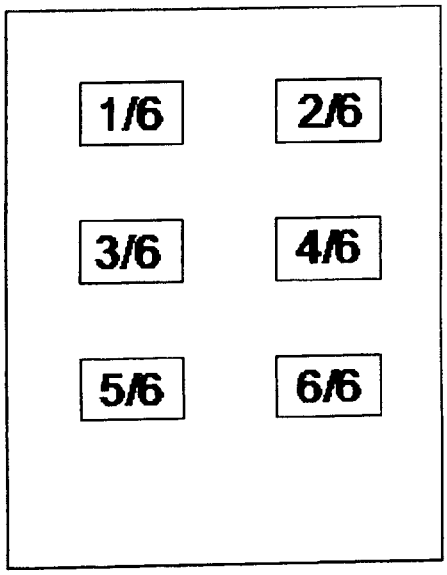
Figure 4:
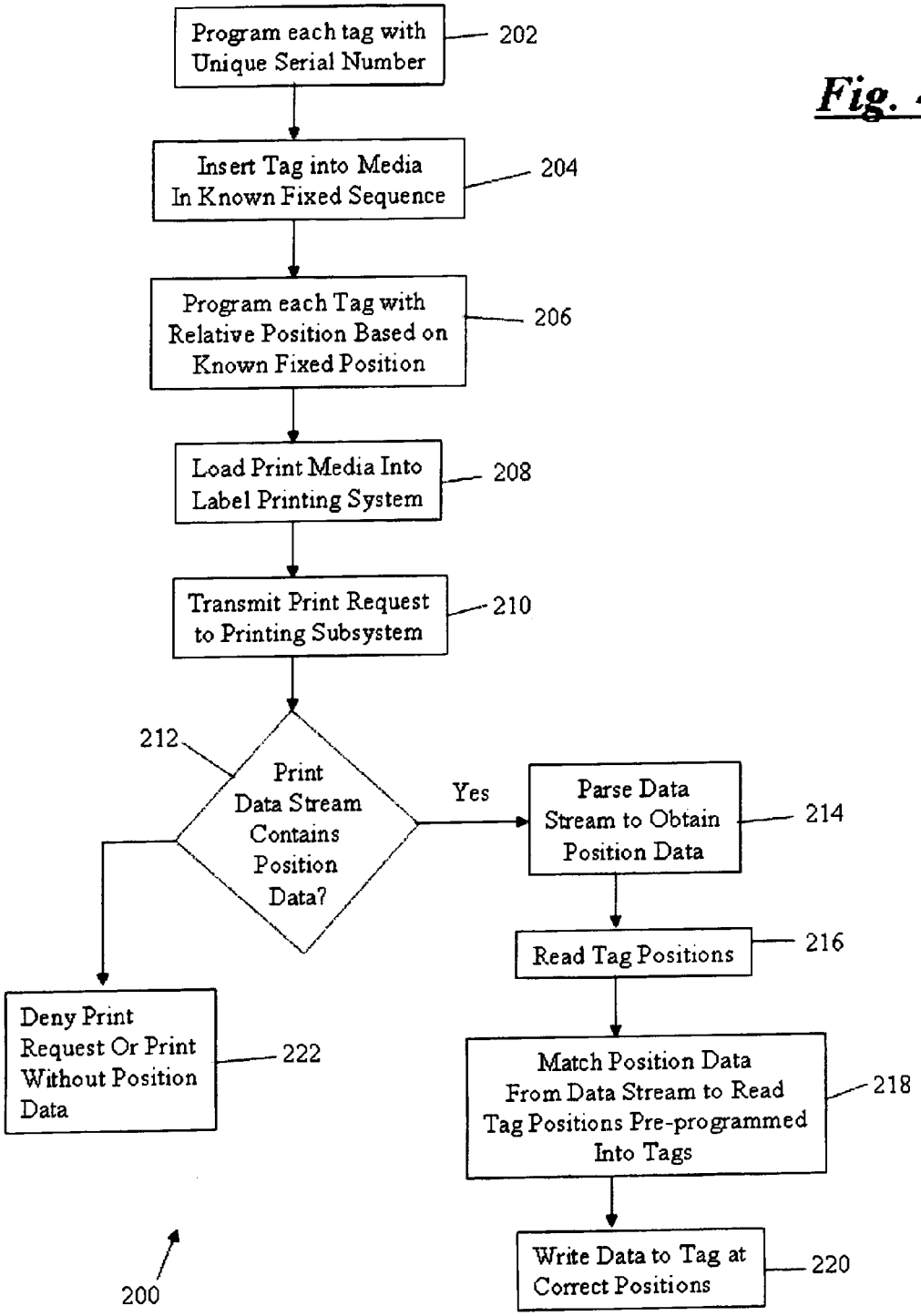
Figure 5:
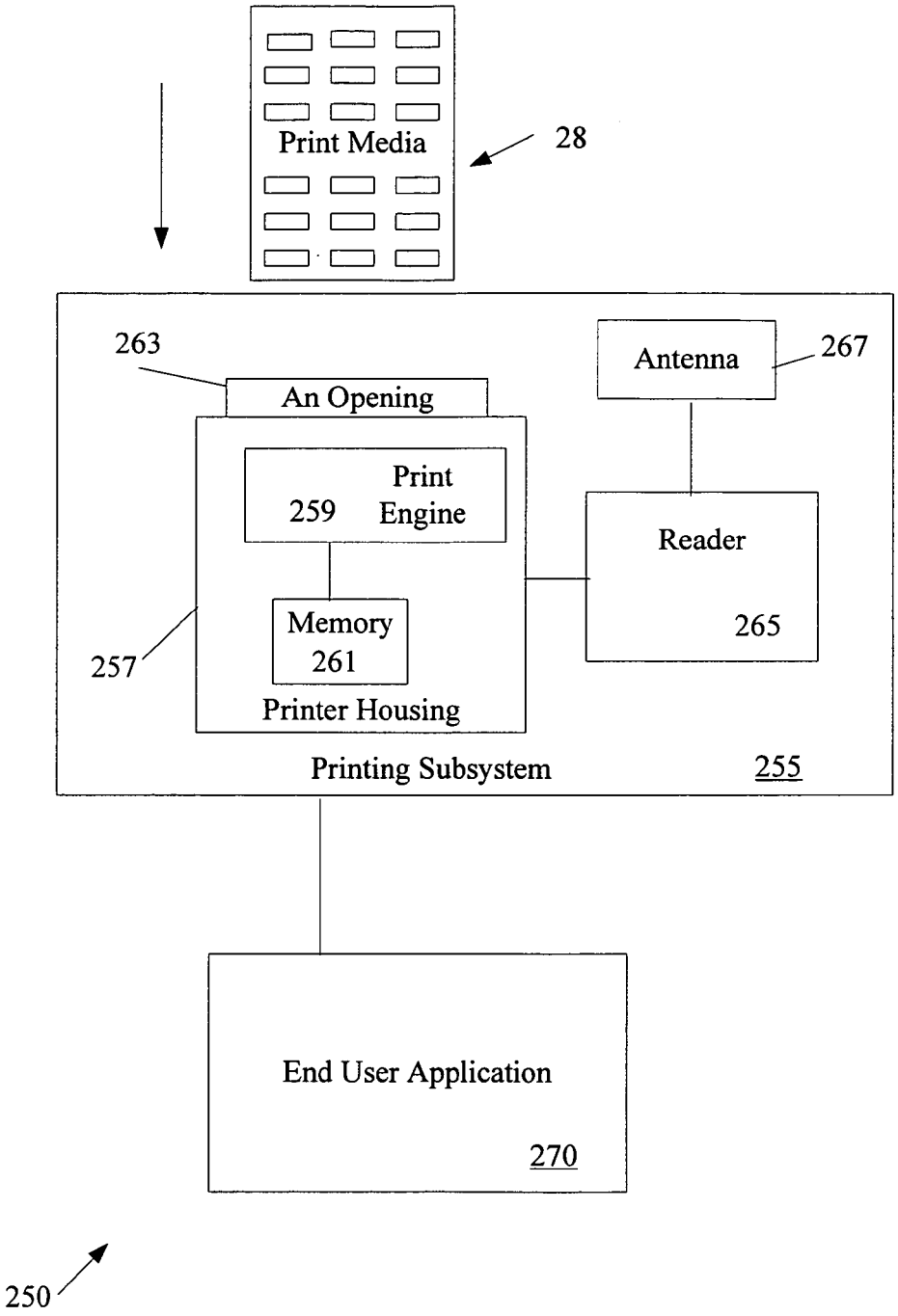

FIGS. 3*a*–3*c* illustrate various relative position encoding schemes which can be used to determine the position of labels on print media having embedded radio frequency devices according to one embodiment of the invention;

FIG. 4 is a process flow diagram showing a method of determining the position of labels on media having one or more embedded radio frequency devices according to one embodiment of the invention; and FIG. 5 is a simplified architectural block diagram of a label printing system for determining the position of labels on media having or more embedded pre-programmed radio frequency devices according to one embodiment of the invention.

DETAILED DESCRIPTION

Figure 1:
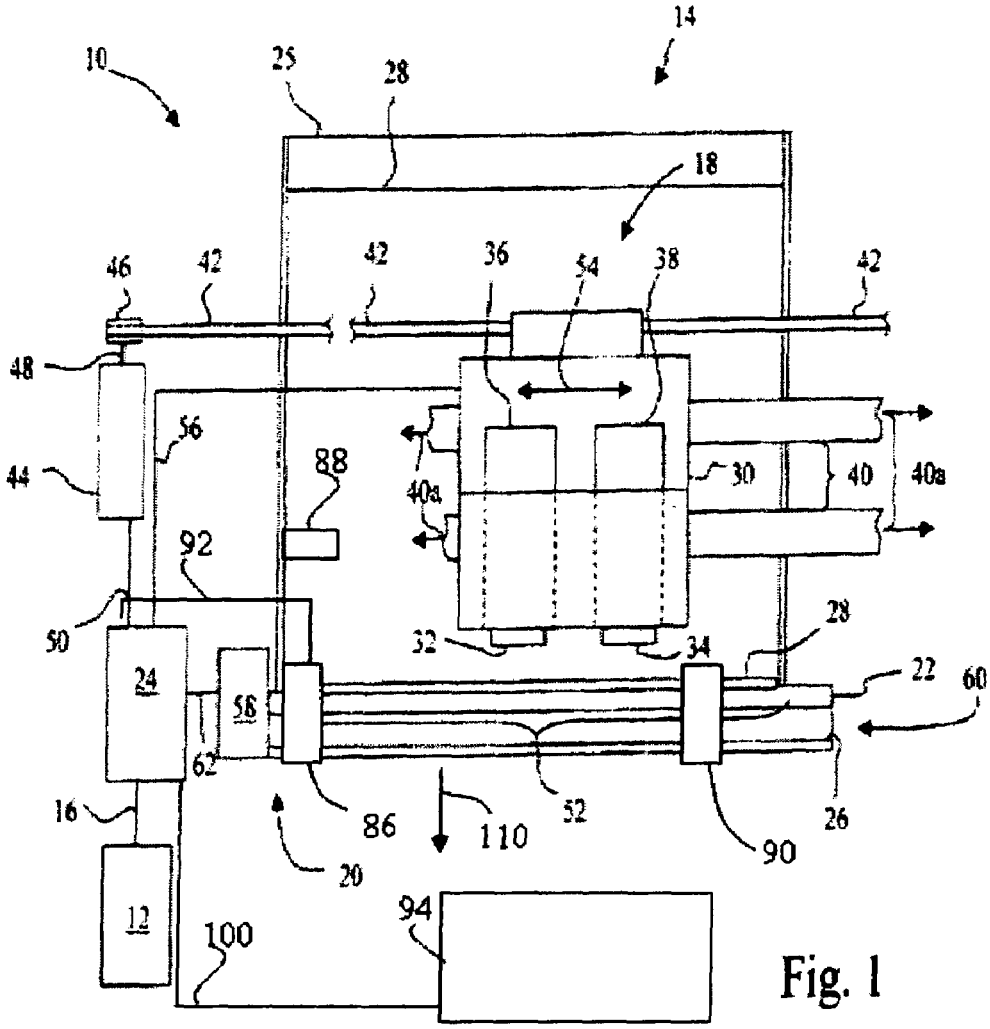
FIG. 1 shows a system for determining the position of labels on media having one or more embedded pre-programmed radio frequency devices according to one embodiment of the invention.

Referring now to the drawings and more particularly to FIG. 1, therein is shown a system 10 for determining the position of labels on print media embedded with pre-programmed radio frequency data storage devices, such as RFID tags, contained on a cut sheet of print media according to one embodiment of the present invention. System 10 may include a printer assembly 14 such as, for example, an ink jet or laser printer or other image forming platform. For convenience, system 10 will be described in connection with an ink jet printer although it should be understood the system 10 of the invention may be implemented in other image forming platforms such as a laser or dye diffusion printer, for example.

Host 12 may be communicatively coupled to printer assembly 14 by way of communications link 16 and may include one or more end-user applications capable of generating a print request. Communications link 16 may be established by, for example, a direct connection, such as a cable connection, between printer assembly 14 and host 12; by a wireless connection; or by a network connection, such as for example, an Ethernet local area network (LAN) or a wireless networking standard, such as IEEE 802.11. Although not shown, host 12 may include a display, an input device such as a keyboard, a processor and associated memory. Resident in the memory of host 12 may be printer driver software which places print data and print commands in a format that can be recognized by printer assembly 14. The format can be, for example, a print data stream that includes print data and printing commands for a given print request and may include a print header that identifies scan data. The printer driver software may also include print media information such as, for example, media type and size. In addition, such print media information may include the known fixed position locations of radio frequency data storage devices, such as a plurality of RFID tags, which have been placed on or embedded in the print media as "Smart" labels or other similar cut-sheet print media. In this regard, for determining the location of labels on print media, the print data stream may include at least two types of data: print data to be used by the print engine and radio frequency data to be programmed into the radio frequency based data storage devices such as RFID tags, for example.

FIG. 1 shows that printer assembly 14 includes a printhead carrier system 18, a print media feed system 20, a mid-frame 22, a master controller 24, a print media source 25 and an exit tray 26. Print media source 25 is configured and arranged to supply individual sheets of print media 28 to print media feed system 20 which, in turn, further transports sheets of print media 28 during a printing operation.

Printhead carrier system 18 includes a printhead carrier 30 which may carry, for example, a color printhead 32 and black printhead 34. A color ink reservoir 36 is provided in fluid communication with color printhead 32 and a black ink reservoir 38 is provided in fluid communication with black printhead 34. Reservoirs 36, 38 may be located near respective printheads 32 and 34, which in turn may be assembled as respective unitary cartridges. Alternatively, reservoirs 36, 38 may be located remote from printheads 32, 34, e.g., off-carrier, and reservoirs 36, 38 may be fluidly interconnected to printheads 32, 34, respectively, by fluid conduits. Printhead carrier system 18 and printheads 32 and 34 may be configured for unidirectional printing or bi-directional printing.

Printhead carrier 30 is guided by a pair of guide rods 40. Alternatively, one of guide rods 40 could be a guide rail made of a flat material, such as metal. The axes 40*a* of guide rods 40 define a bi-directional-scanning path, also referred to as 40*a*, of printhead carrier 30. Printhead carrier 30 is connected to a carrier transport belt 42 that is driven by a carrier motor 44 by way of a driven carrier pulley 46. Carrier motor 44 has a rotating carrier motor shaft 48 that is attached to carrier pulley 46. Carrier motor 44 is electrically connected to print controller 24 via communications link 50. At a directive of print controller 24, printhead carrier 30 is transported, in a reciprocating manner, along guide rods 40. Carrier motor 44 can be, for example, a direct current motor or a stepper motor.

The reciprocation of printhead carrier 30 transports ink jet printheads 32 and 34 across the sheet of print media 28 along bidirectional scanning path 40*a* to define a print area 52 of printer assembly 14 as a rectangular region. This reciprocation occurs in a scan direction 54 that is parallel with bidirectional scanning path 40*a* and is also commonly referred to as the horizontal scanning direction. Printheads 32 and 34 are electrically connected to print controller 24 via communications link 56.

During each printing pass, i.e., scan, of printhead carrier 30, while ejecting ink from printheads 32 and/or 34, the sheet of print media 28 is held stationary by print media feed system 20. Before ink ejection begins for a subsequent pass, print media feed system 20 conveys the sheet of print media 28 in an incremental, i.e., indexed, fashion to advance the sheet of print media 28 into print area 52. Following printing, the printed sheet of print media 28 is delivered to print media exit tray 26. Print media feed system 20 includes a drive unit 58 coupled to a sheet handling unit 60. Drive unit 58 is electrically connected to print controller 24 via communications link 62, and provides a rotational force which is supplied to sheet handling unit 60.

As such, printer assembly 14 provides a print media pathway, represented by arrow 110, for the transport of print media 28 from a paper source 25 to a designated print area 52. Printer assembly 14 may include a print media sensor 86 capable of detecting when print media 28 has reached a predetermined point along the print media pathway 110. Print media sensor 86 may be configured to detect the leading edge of the print media 28 as it is conveyed by the print media feed system 20 through the printer assembly 14. In addition to, or alternatively, the print media sensor 86 may detect the trailing edge of the print media 28. In this regard, the leading edge of the print media 28 is defined as the media edge which enters the printing device's print area 52 first and the trailing edge is equivalently to that edge which enters the print area 52 last.

The invention has particular application and provides particular advantages in the context of modern day image forming devices, such as printer assembly 14 and other commercially available types of printer platforms, where print media, such as print media 28, contains multiple radio frequency data storage devices, such as RFID tags, to which data can be written using one or more data programmers, such as an RFID reader/programmer with one or more antennas, for writing data to the radio frequency data storage devices. Such RFID reader/programmers are readily available and their details of operation and use are known to those of ordinary skill. The use of such reader/programmers to determine the position of such devices which are embedded on print media, however, is unique, novel and non-obvious.

Figure 2:
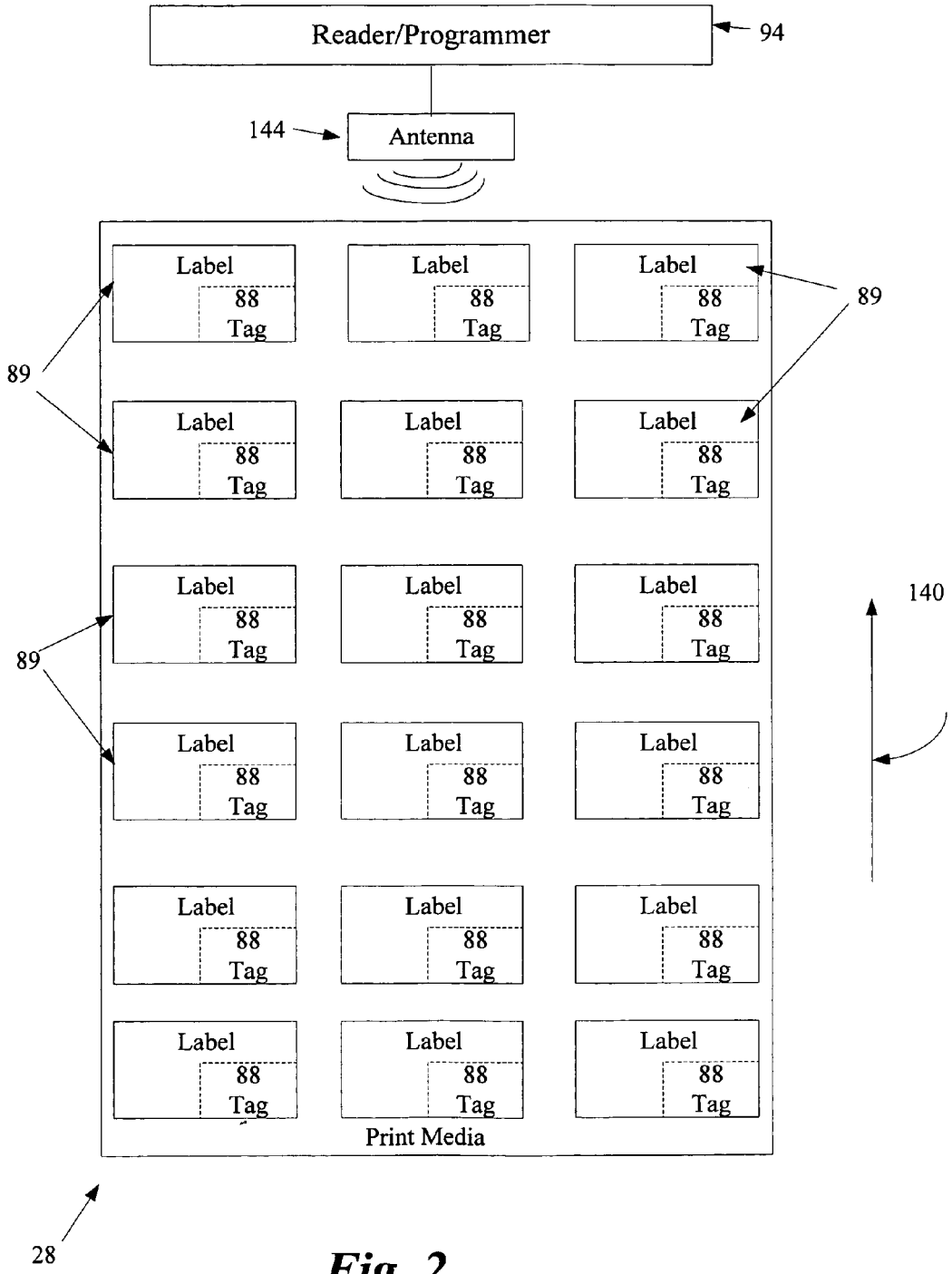
FIG. 2 shows a sheet of print media containing a plurality of radio frequency devices which store position data.

Referring to FIG. 2 therein is shown a cut sheet of print media 28 having a plurality of labels 89 and a plurality of pre-programmed radio frequency tags 88. The specific configuration of print media 28 shown uses a radio frequency tag 88 for each label 89. It should be understood, however, that more or less tags may be employed for each label and that other configurations of the print media 28 may be utilized. Also, it should be understood the invention can apply equally as well to print media having no labels such as is the case with media known as Smart Paper wherein the tags 88 are inserted into the print media without labels. In either case, the pre-programmed radio frequency tags 88 typically comprise RFID tags having memory for storing a variety of data. In one embodiment, each tag 88 (the terms "tag" and "tags" shall be used interchangeably) may be programmed to contain user specific information such as, for example, the address and identification of an intended recipient, order number, date of shipment and other types of label specific data. In addition, each tag may be pre-programmed with a unique serial number that allows each tag to be identified. Typically, the serial number would be programmed by the tag manufacturer and the tag 88 would be inserted into a label 89 (or directly on the print media 28 in the case of Smart Paper) in a known, fixed sequence. In this way, the physical location of a tag 88 on a page of print media 28 is fixed and will not change until a label 89 is removed. Thus, during manufacture of the print media 28, an RFID reader/programmer may be used to pre-program each tag 88 with data indicating its relative position on the page of print media 28 based upon a known fixed position for each application.

As shown, labels 89 and pre-programmed radio frequency tags 88 are arranged into rows and columns. It should be understood, however, that other positions and configurations of the labels 89 and tags 88 may be employed and that more or less columns and rows may exist according to various media configurations. Further, it should be understood the use of labels 89 for purposes of the invention is optional as would be the case where tags 88 are directly inserted on the media without labels.

Arrow 140 indicates the direction of travel of media 28 along a print media pathway such as print media pathway 110. As discussed above, one or more sensors arranged about a printer's print media pathway 110 may be used to determine and track the location of print media 28 as it passes through the printer's print area, such as print area 52. Such sensors may be arranged to "make" at the leading edge of a sheet of print media and "break" at the trailing edge, providing a master controller, such as master controller 24, with an indication of the location of the print media 28 at any given point along the printer's print media pathway 110. For this purpose, printer assembly 14 may include a second print media sensor 90 which functions like first print media sensor 86. In either configuration, i.e. one or two print media sensors, a communications link 92 is provided between the print media sensor 86 and the master controller 24.

Communications link 92 provides a means for print media sensor 86 to signal master controller 24 and thereby notify master controller 24 that a sheet of print media, such as print media 28, has been detected. A similar communications link (not shown) may be provided coupling the second print media sensor 90 to the master controller 24. In this way, the master controller 24 will know when the leading edge and/or trailing edge of the print media 28 traverses the print area 52 and/or a predetermined point along the print media pathway 110.

Thus, a plurality of pre-programmed radio frequency tags 88 have been placed on or embedded in print media 28 at specific locations and data stored on tags 88 can be used to determine the relative position of the tags 88 on the page of print media 28. A radio frequency data programming device 94, such as an RFID reader/programmer, may be placed about the printer assembly 14 in an area where it can write data to the pre-programmed radio frequency tags 88 using known techniques. In practice, write operations may commence once print media 28 has reached a predetermined point along the print media pathway 110.

Since pre-programmed radio frequency tags 88 are contained on print media 28, a radio frequency data programming device 94 can be used to write data to and read data from radio frequency tags 88 using antenna 144. While a single antenna 144 is shown, multiple antennas may be used across the horizontal axis of the print media pathway 110 so that their positions roughly correspond to known or expected positions of the columns of radio frequency data storage devices. As print media passes within range of antenna 144, data can be written to or read from each of the tags 88.

Master controller 24 of print assembly 14 may confirm if pre-programmed radio frequency tags 88 contained on print media 28 are positioned as expected on print media 28. As such, master controller 24 provides the necessary process logic for reading position data from the tags 88 and for comparing the read position data with position data obtained in a print data stream received from an end-user application. Communications link 100 coupling radio frequency data programming device 94 to master controller 24 may provide a signal pathway for this purpose.

Thus, in one embodiment, the present invention provides a system that uses a printing subsystem, such as printer assembly 14, and a radio frequency reader, such as radio frequency data programming device 94 having a radio frequency antenna 144, for reading pre-programmed data from the radio frequency tags 88 in order to determine the relative position of the tags 88 on the print media 28. The system reads the information contained on tags 88 on the page of print media 28 and extracts from each tag 88 its position indicating data. During printing, the printing subsystem may receive a print data stream from a user application operating on a user platform, such as host 12. The print data stream for each page may include two types of data: print data to be used by the print engine of the printing subsystem, and RFID data to be programmed into the tags 88. Each piece of RFID data may also include an indication of tag position on the page of print media 28 that corresponds to the data pre-programmed into exactly one of the tags 88 on the page. The printing system can match the pre-programmed position data from the tags 88 with the position data in the print data stream to determine which data to program into each tag 88. The data to be programmed into the tag 88 may overwrite the pre-programmed position data, or can be appended after the position data, as required by the end-user application.

There are several possible schemes for encoding relative position into the tags. Each has different strengths, and may be more or less useful in a particular application. FIGS. 3*a* thru 3*c* illustrate a few potential examples for a relative position encoding scheme that may be used in order to indicate the relative position of a label on a sheet of print media. It should be understood that the examples of FIGS. 3*a*–3*c* serve only to illustrate the invention, but should not be understood to limit its application. The data chosen to be pre-programmed into the tags is not important, only that the data is also known to the application and therefore may be used to key end-user tag data to a specific tag 88 with respect to its position on the page on print media 28.

FIG. 3*a* shows that position data may be encoded on each tag 88 with the X/Y position in physical units (e.g. inches or mm) of a known tag feature (e.g. center, a corner, or the chip position) from a known feature on the sheet (e.g. a given corner) of print media 28. This may have the advantage of providing increased precision in locating randomly placed tags.

FIG. 3*b* illustrates another example of a relative position encoding scheme that is useful where tags 88 are uniformly distributed over the area of the print media 28 (say, an array of 3 across by 8 down). With the encoding scheme of FIG. 3*b*, an array index is assigned to each tag 88 indicating its position relative to the other tags 88. For example, the upper-left corner tag in an 3×8 array would be encoded with (1, 1), and the tag immediately below it would be encoded with (1, 2). The lower-right corner tag would be encoded with (3, 8).

A third example for a relative position encoding scheme is shown in FIG. 3*c*, which involves the simple assignment of a sequence number to the tags 88. This sequence can be in any order with respect to the tags' actual physical location, so long as the sequence is both known and fixed. For example, a sheet with six tags would have each tag encoded with a number from 1 to 6 in some known order. It may also be helpful to encode each tag with the total number of tags on the sheet ("2 of 6" rather than simply "2"). A variant on this scheme is to require the tags 88 to be placed in increasing serial number order. The serial numbers need not be consecutive, so long as they are placed in a known order.

In each of these cases, the numbering scheme and sequence of the tags 88 for the print media 28 is known to the end-user application. The data to be programmed into each tag 88 may be assigned a position using the same scheme as the label media, and the printing subsystem need only match the position information in the data stream with the position information in the tags 88 to program the correct data in each tag 88.

FIG. 4 is a process flow diagram showing a method, denoted generally as 200, of determining the position of tags on media having one or more embedded radio frequency devices. Method 200 begins at step 202 wherein each tag is programmed with a serial number that allows a radio frequency reader/programmer to uniquely identify each tag. Preferably, this is accomplished during manufacture of the tags or the print media. Next, at step 204, the tags are embedded into the print media, such as print media 28, in a known fixed sequence. Step 204 may involve placing tags on labels which in turn are inserted on the print media for creating Smart Labels. In either case, at this point the physical location of the tags 88 on the print media will not change unless, in the case of Smart Labels, a label is removed from the web at application.

During manufacture process, the tag insertion equipment may then program each tag with relative position data, step 206, based on the known fixed position of the tags on the print media. At some point the print media is inserted into the printing subsystem, step 208, and a print request is transmitted to the printing subsystem, step 210. The print request may take the form of a print data stream for each page of print media on which data is to be printed. The print data stream may include two types of data: print data to be used by the print engine, and RFID data to be programmed into the tags 88. In addition, each piece of RFID data may also include an indication of the position on the page that corresponds to the data pre-programmed into one of the tags on the page of print media.

At step 212, a determination is made if the received print data stream contains position data. If not, process flow is directed to step 222 wherein the print request is denied or printing occurs without position data. However, if the data stream does contain position data, process flow to step 214 wherein the data stream is parsed into its constituent components in order to obtain the position data of the tags to be printed. Next, at step 216 the tags are read in order to obtain the pre-programmed position data contained on the radio frequency data storage devices, such as tags 88. This permits a comparison of the position data contained in the print data stream with the position data pre-programmed in the tags 88. Once the match is accomplished, data can be written, step 220, at the correct positions. The data to be programmed into a particular tag can be written over the pre-programmed position data to conserve memory space on the device or the data can be appended after the position as determined by the end user application.

Having described the details of a system for determining the position of tags on print media having radio frequency data storage devices embedded therein, FIG. 5 illustrates the essential components of such a system in simplified block diagram form. Specifically, FIG. 5 shows a system 250 having a printing subsystem 255 that may include many of the operational components of a typical printer assembly, such as printer assembly 14. The printing subsystem 255 includes a printer housing 257 in which a print engine 259 resides. Printing subsystem 255 also has memory 261 for storing data indicating the position of tags on media. The contents of memory 261 can be obtained from an end-user application 270 which may supply the position data to the printing subsystem 255 in a print data stream.

The printer housing 257 includes an opening 263 into which the print media 88 may be fed into the printing subsystem 255 for printing on the print media 28. As the media 28 is fed into the printing subsystem 255, a radio frequency reader 265 reads the data pre-programmed into the tags on the media 28. Antenna 267 is provided for this purpose. In this way, the reader 265 reads pre-programmed position data from the radio frequency tags, such as tags 88, and the printing subsystem 255 compares the pre-programmed position data with position data contained in a print request data stream to determine the position of at least one label on the print media 28. Thus, the invention utilizes the ability to pre-program the tags with their location, and then read that data in the printer system 250, to solve the problem of correlating the data to be printed on the print media with the data to be programmed into one or more tag on the media.

It should be understood that modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. For media having one or more embedded pre-programmed radio frequency tags, a printing system for determining the position of the tags on the media comprising:

a printing subsystem for fixing images on said media, said printing system including memory for storing data indicating the position of said tags on said media;

a radio frequency reader communicably coupled to said printing subsystem and including at least one radio frequency antenna for reading pre-programmed data from said radio frequency tags;

wherein said reader reads pre-programmed position data from said radio frequency tags and said printing subsystem compares the pre-programmed position data with position data contained in a print request data stream to determine the position of at least one tag on said print media.

2. The system of claim 1 wherein said radio frequency tags are arranged in columns and rows on said print media and wherein said pre-programmed position data is encoded using a relative position encoding scheme.

3. The system of claim 2 wherein said relative position encoding scheme indicates the X/Y position of each of said tags on said print media.

4. The system of claim 2 wherein said relative position encoding scheme indicates the array position of each of said tags on said print media.

5. The system of claim 2 wherein said relative position encoding scheme indicates the sequence order of each of said tag on said print media.

6. The system of claim 5 wherein the sequence order indicates the total number of radio frequency tags on the print media.

7. The system of claim 1 further comprising an end-user application communicably coupled to said printing subsystem and adapted to receive a print request data stream including print data to be affixed to a label on said print media and radio frequency data to be programmed into a tag associated with said label.

8. The system of claim 7 wherein said radio frequency data further comprises position data for said specific label.

9. The system of claim 1 wherein said printing subsystem prints data contained in said print request data stream on a label on said print media.

10. Apparatus for determining the position of tag on media having one or more embedded pre-programmed radio frequency tags comprising:

a printer assembly having a media pathway and a print engine for achieving a plurality of printing functions;

an interface coupling said printer assembly to a radio frequency reader/programmer capable of reading data from and writing data to radio frequency identification tags;

storage means for storing pre-programmed position data indicating the position of at least one radio frequency identification tag on a sheet of print media, said pre-programmed position data obtained by a radio frequency tag reader/programmer reading data from at least one radio frequency tag on a sheet of said print media; and process logic for receiving and processing print request data streams and comparing pre-programmed position data to position data received in a print request data stream to determine the position of at least one tag on said sheet of print media.

11. The apparatus of claim 10 wherein said process is further adapted for parsing position data according to a relative position encoding scheme.

12. The apparatus of claim 11 wherein said relative position encoding scheme indicates the X/Y position of a tag on said print media.

13. The apparatus of claim 11 wherein said relative position encoding scheme indicates the array position of a tag on said print media.

14. The apparatus of claim 11 wherein said relative position encoding scheme indicates the sequence order of a tag on said print media.

* * * * *